United States Patent [19]

Gardner, Jr.

[11] Patent Number: 4,590,767

[45] Date of Patent: May 27, 1986

[54] HOT GAS ENGINE AND VEHICLE DRIVE SYSTEM

[76] Inventor: Elmer W. Gardner, Jr., 3359 Alexis Rd., Groesbeck, Ohio 45239

[21] Appl. No.: 706,451

[22] Filed: Feb. 27, 1985

Related U.S. Application Data

[63] Continuation-in-part of Ser. No. 238,587, Feb. 26, 1981, abandoned.

[51] Int. Cl.[4] ..... F01K 15/00

[52] U.S. Cl. ..... 60/668; 60/698; 180/165

[58] Field of Search ..... 60/668, 652, 698, 712, 60/706; 180/165

[56] References Cited

U.S. PATENT DOCUMENTS

| | | | |
|---|---|---|---|
| 3,923,115 | 12/1975 | Helling | 180/165 X |
| 4,123,910 | 11/1978 | Ellison, Sr. | 60/698 |
| 4,163,367 | 8/1979 | Yeh | 60/668 X |
| 4,290,268 | 9/1981 | Lowther | 60/668 |
| 4,372,414 | 2/1983 | Anderson et al. | 180/165 |
| 4,383,589 | 5/1983 | Fox | 180/165 |

*Primary Examiner*—Stephen F. Husar

[57] ABSTRACT

The invention comprises a vehicle having wheels, a drive shaft, and a gasoline or diesel engine as a primary source of power, and an air operated engine and an electrohydraulic motor coupled to the drive shaft as the secondary and auxiliary power. Coupled to the output shaft of the air engine is a rotary vane which utilizes bypassed exhaust gases from both the gasoline/diesel engine and the air engine as an auxiliary assist to the air engine, and both the rotary vane and the air engine compress air for storage during vehicle deceleration and braking. Kinetic energy for operating the secondary and auxiliary power to the vehicle is recovered by the application of an alternator, hydraulic pump and an air compressor to each moving tire and the drive train shaft of the non stationary vehicle during acceleration, deceleration and braking. The recovered kinetic energy is transmitted either directly to the auxiliary power equipment for immediate application or is stored for later use. An independent and centralized electric monitoring system containing a series of electrical switches, sensors, transducers and valves monitor and control the operation of the air engine, the rotary vane, the electrohydraulic motor and also the alternators, air compressors and hydraulic pumps in the recovery of electricity, compressed air and hydraulic fluid, providing for an on-going operating system for the time sharing of power between the conventional vehicle power system and that of the auxiliary power supply.

3 Claims, 9 Drawing Figures

OSCILLATOR

HOT GAS ENGINE AND VEHICLE DRIVE SYSTEM

RELATED U.S. APPLICATION DATA

Continuation-in-part of Ser. No. 238,587, Feb. 26, 1981 Hot Gas Engine and Vehicle Drive System, now abandoned.

REFERENCES CITED

U.S. Patent Documents

U.S. Pat. No. 3,923,115, 12/1975, Helling, 180/165XR;
U.S. Pat. No. 4,123,910, 11/1978, Ellison, Sr., 60/698;
U.S. Pat. No. 4,163,367, 8/1979, Yeh, 60/668XR;
U.S. Pat. No. 4,290,268, 9/1981, Lowther, 60/668;
U.S. Pat. No. 4,383,589, 5/1983, Anderson, 180/165;
U.S. Pat. No. 4,383,589, 5/1983, Fox, 180/165.

TECHNICAL FIELD

This invention relates to a non polluting auxiliary power for a vehicle that includes a monitoring system for the recovery of kinetic energy.

BACKGROUND OF THE INVENTION

Although air operated engines have been in existence for nearly a century, and the art of operating such an engine is well known and common knowledge, the application of such an engine for powering non stationary vehicles has not been standardized nor applied commercially, apparently because gasoline, as a fuel for the internal combustion engine, has always been available and in abundant supply that would meet any demand for a source of energy.

Possibly for this reason no concentrated attempt was ever made to develop a method for adequately supplying compressed air as a fuel, either internally within the engine or by adaptation of external devises, that would give a constant and continual supply of energy for long term and continuous operation of a non stationary vehicle, without depending upon a stored supply of compressed air.

However, air operated engines have been quite feasible for stationary power operations and most notably the Stirling Engine, which has proven to be very useful in commercial and industrial applications. And a number of air operated devices have been invented that apply the operation of motors, rotary vanes and other equipment of the wheel and drive shaft of a vehicle, though such devices are limited in their operation to the amount of compressed working fluid available and, even though many work on the principle of compressing air during braking and deceleration in order to generate fuel for operation of an air engine, the continual and constant supply of compressed air that is needed, particularly for contingency demand, is lacking in scope and quantity and does not fulfill the requirements for operating a non stationary vehicle for a commercial application.

The need for a vehicle that can be operated continously over long range and in a commercial manner with an alternative fuel to gasoline, oil and other fossil fuels is apparent and this need will not lessen but only become greater with the passing of time, as the world population increases and consequently the demand, and the evident decrease in the availability of such fuel. An air operated engine supplemented with an alternative energy source and to the gasoline/diesel engine is the most feasible approach to solving this problem at the immediate moment and, as more advanced technology becomes available and the assimilation is possible, the application should be for a total self sustaining air operated engine with an on-board energy recovery and regenerative system that can be used for commercial application for driving non stationary vehicles in a comparable manner to that of current conventional gasoline or diesel engine driven vehicles.

SUMMARY

This invention has considerable advantage over other types of compressed fluid power systems previously used in that the limited supply of energy normally available for compressed fluid drive for a non stationary vehicle is offset by the increase in power demand—the physical structure of this invention allows for considerable mechanical advantage—and the amount of kinetic energy that is retrieved during normal non stationary vehicle operation permits it to be a commercially suitable power system in conjunction to the operation of the gasoline or diesel engine powered non stationary vehicle.

Previously invented air operated engines have experienced difficulty in meeting the supply and demand for compressed working fluid during specific power requirements as would be needed with heavy usage and peak demand in non stationary vehicle drive. A constant compressed fluid supply of sufficient pressure is needed in order for such a non stationary vehicle drive system to be commercially successful and, though the air supply is abundant, it must be recovered and stored for later use or be made available for contingent demand and put to use during vehicle operation, for it is not possible to depend completely upon a stored compressed fluid supply to meet absolute energy requirements. This invention comprises several sources for recovering kinetic energy and a compressed working fluid supply within the physical operational mechanics of a non stationary vehicle which replenishes a high percentage of the compressed working fluid needed for the normal operation of a non stationary vehicle and in addition to the compressed working fluid that can be stored in tanks.

Having a satellite compressor, hydraulic pump and alternator/generator adaptable to each tire of each wheel and to the drive train shaft differential is a method for braking the vehicle and also for recovering kinetic energy. Additionally, a rotary vane, which is adapted to the output shaft of the air engine, serves as an air compressor during vehicle braking and deceleration. During acceleration of the air engine and the gasoline or diesel engine, exhaust gases are bypassed from these engines in a closed circuit air line to the rotary vane and the exhaust gases rotate the vanes therein which assist in rotation of the output shaft to the air engine. The air engine, which comprises a plurality of cylinders arranged in circumference to one single output shaft that is coupled means clutch mechanism to the vehicle drive train shaft, and during braking or deceleration, is converted to an air compressor by the application of the electric monitoring system electrically closing valves to the compressed air lines and opening valves for input of ambient air to the cylinder.

Each cylinder having at least two double acting pistons therein and a piston rod adapted for driving connecting rods that are adapted to and drive gears that in turn drive the main output shaft to the engine. During acceleration the monitoring system electrically opens the valve in the compressed air line for release of compressed air from a storage tank or directly from satellite compressors, the compressed air is heated by a series of heat resistive elements that are located to the intake ports at the cylinder and to the piston heads inside the cylinder. As the storage tank, air lines and compressors are arranged for a closed circuit recycling system, gas that is exhausted through the rotary vane is recompressed at the satellite compressors and transmitted to storage for later use of it is returned in compressed form to the air engine for immediate application.

As air is heated when compressed, before entering the compression chamber of the air cylinder it is passed through a cooler so that it will be more condensed and available for expansion upon heating inside the cylinder during the compression stroke of the piston, thus allowing for greater expansion and the production of greater work in moving the piston.

Also, as auxiliary power to the air engine and the gasoline or diesel engine an electrohydraulic motor is adapted to the drive train shaft of the vehicle for contingency demand. The motor is controlled by the monitoring system.

Electricity generated by the alternator/generator is fed by wire either directly to the electric motor or is transmitted to storage batteries for later use. It can be either AC or DC and is filtered through a stepup transformer before application to the electric motor. The alternator/generator also generates electricity for the electric monitoring system which is independent of the electrical system to the conventional gasoline or diesel engine and its electrical operating system.

The electric monitoring system is the central controller for all electrical switches, sensors, transducers, heat exchangers, solenoids, fan motors, AC-DC converter, valves, and relays that comprise the hot gas engine and vehicle drive system, and it controls the complete kinetic energy recovery system and also the operation of the time sharing of power between the two engines by automatically sensing the need for recovery of kinetic energy by energizing electrical mechanisms, for engaging satellite alternators/generators, hydraulic pumps and air compressors or by opening valves for the release of compressed working fluid to the air cylinders for acceleration and the application of the air engine as auxiliary power. Hydraulic fluid pumped by the hydraulic pumps is fed by pipe line to a reservoir for storage and later use or directly to the hydraulic motor or to the power steering or braking system of the vehicle for immediate application.

Objects of the Invention are: (1) To provide a non polluting compressed fluid propulsion system for non stationary vehicle drive (2) To provide an auxiliary power source for use in conjunction with the gasoline or diesel engine (3) To provide a method of recovering kinetic energy that also serves as a system for braking a non stationary vehicle (4) To use the air engine and rotary vane for braking and in the recovery of kinetic energy (5) An electrical monitoring system that automatically controls the kinetic/energy recovery system of a non stationary vehicle and that also provides for the time sharing of power between two different vehicle drive systems.

DETAILED DESCRIPTION OF THE DRAWINGS

DETAILED DESCRIPTION OF THE INVENTION

The description of the invention is detailed from FIG. 1 through FIG. 9 that covers the monitoring system, the air storage and supply system, the kinetic energy recovery system and the electrohydraulic motor as the auxiliary power system in addition to that of the hot gas engine to the gasoline or diesel engine as the primary source of power in driving a non stationary vehicle.

Detailed is a standard method and the best mode for carrying out the invention. The practicality of the invention is fully shown and its ability to partially relieve the internal combustion engine of its pollution problems and energy requirements should justify its adaption thereof.

The electrical monitoring system explained herein and mechanical components that are necessarily standard and well known in the industry are not described in detail for that reason. Such items as resistors, transistors, diodes, relays and bearings are common to the industry and descriptive connotation has not been made.

It should be understood that the word acceleration as described for vehicle movement is connotative of forward movement although the word forward is not always used with this word. And the word reverse is always used with a reverse movement of the vehicle.

Figure 1:
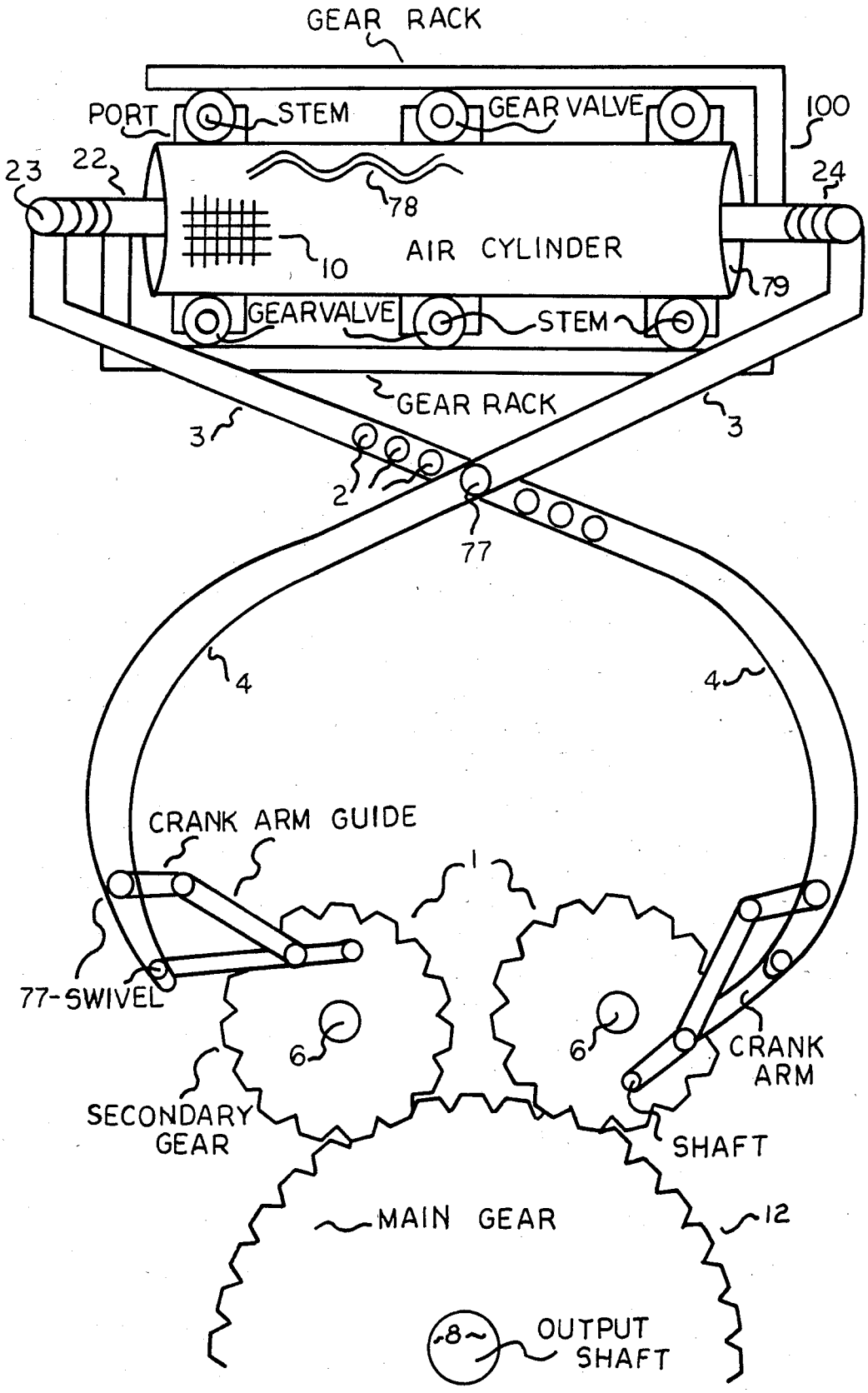
FIG. 1, is a drawing of the arrangement of the air cylinder and its operating elements to the output shaft and shows a plurality of input and output gear valves to the cylinder, connecting rods adapted to piston rods of the cylinder and to connecting rods that are connected to crank arms adapted for driving gears and to the output shaft.
Figure 2:
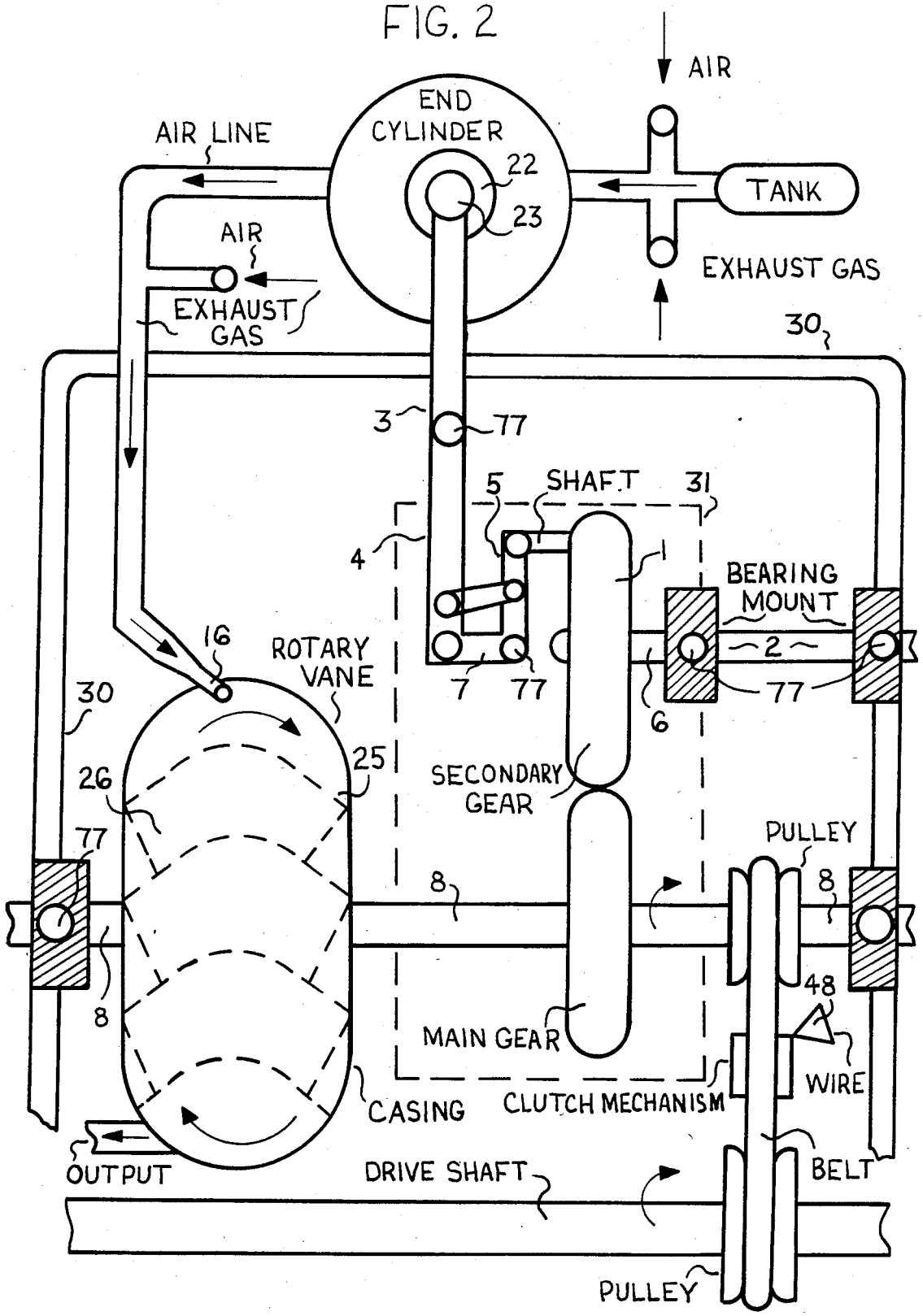
FIG. 2, is a drawing showing the clutch and pulley assembly for driving the output shaft of the Hot Gas Engine and also the drive shaft of the vehicle. It shows the position of the rotary vane and the air lines leading thereto and to the cylinder.

FIG. 1 is a diagram of one cylinder to the Hot Gas Engine and it shows the operating elements to the output shaft and the arrangement of input and output valves to the cylinder. Any number of air cylinders can be arranged in circumference to the main gear that is fixed to the main output shaft (FIG. 2) and the one output shaft can be driven by any number of secondary gears 1. However, there can be one or any number of main gears, and at different locations to the main output shaft (FIG. 2). Preferably, the secondary gears and the main gear should be herringbone gears and the step gear arrangement would be more efficient and have less noise than the single tooth spur gear.

FIG. 1, shows at least two secondary gears 1 that are either fixed or rotate to a shaft 6. The mounting arrangement for the shafts is explained in FIG. 2. Each secondary gear 1 has a set of crank arms that have swivel connections for free reciprocating movement. One end of the first crank arm is connected to the outer circumference to the secondary gear 1 by a bearing that is mounted to a shaft that is fixed to the secondary gear 1. The bearing allows the end of the crank arm at the secondary gear 1 to move freely as the secondary gear 1 is rotated to the shaft 6. The other end of the crank arm is connected to a lower connecting rod 4 by means of a bearing swivel. A crank arm guide, that holds the crank arm into position to the secondary gear 1 and the connecting rod 4, is mounted by a swivel and bearing at right angles to the crank arm and connecting rod. Each secondary gear 1 is meshed to the main gear, and as the two secondary gears 1 are rotated by the crank arms to the reciprocating movement of the lower connecting rods 4 they rotate the main gear which in turn rotates the main output shaft to the engine (FIG. 2).

FIG. 1, the two lower connecting rods 4 intersect and are adapted to a bearing 77 that is adapted to a pivot point bolt 76 that is fixed to a mounting. (This is explained in FIG. 2). Adjusting holes 2 are in the upper connecting rods 3 for adjusting the length of the connecting rods that can either increase or decrease the length of its stroke that would either increase or decrease the speed of rotation of two secondary gears 1. This adjustment can either increase or decrease the torque provided to the main gear and output shaft.

Each of the upper connecting rods 3 are connected to a swivel 23 that is adapted to the end of a piston rod 22 that has a screw adjustment 24 for adjusting the length of the piston rod which is also another method for increasing or decreasing the length of the stroke to the connecting rods 3 and 4.

Figure 4:
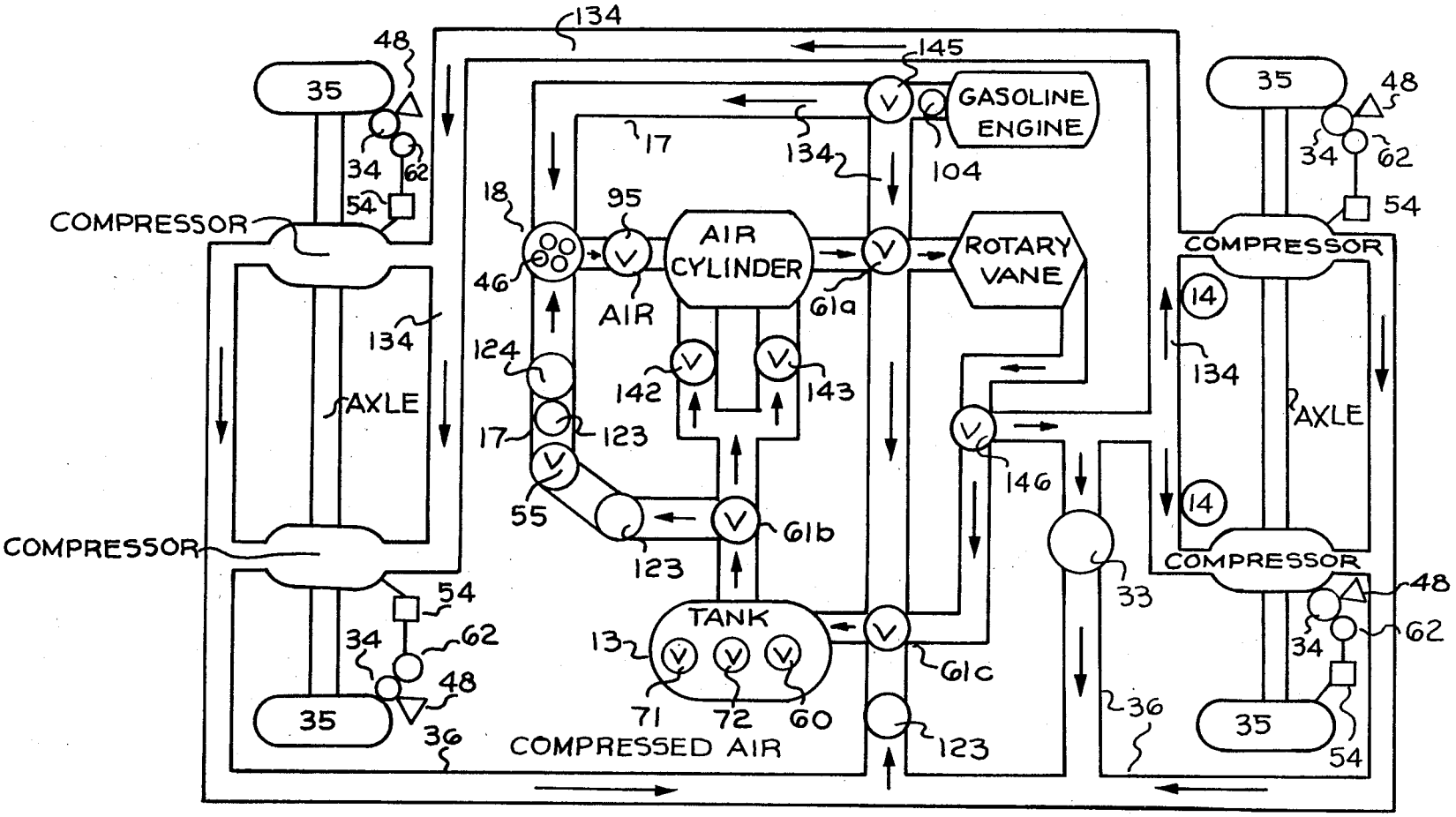
FIG. 4, is a drawing of the compressed air supply system showing the valves that control the flow of working fluid to the air cylinder and also the flow of exhaust gases from the first and second engine to the rotary vane and to the compressors and the flow of compressed air to storage.

Depending upon the amount of horsepower and torque required for the air operated engine, the size and shape of the secondary gears, the main gear, and the connecting rods 3 and 4 could be designed to meet the overall requirements of the engine. And installing an idler gear (not shown) that could mesh between each secondary gear 1 and the main gear is a method for reversing the movement and rotation of the main gear, thus the application of reverse gearing to the engine. One cylinder and its operating elements is reserved for reverse engine gearing, whereas this cylinder would be inoperational for the input of compressed air for acceleration in the forward movement but would be operational for the compression of air during braking or deceleration (This is fully described in FIG. 4). In FIG. 4, the method would be to have a manual control to solenoid valve 6(*b*) for the input of compressed air to this particular cylinder. All other cylinders in the engine arrangement would not receive compressed air during a reverse engine operawtion and would receive compressed air only during forward acceleration. This is an optional arrangement and normally should not be applied and the engine would not be adapted for this arrangement when an electrohydraulic motor (FIGS. 5 and 8) is available because these motors could supply ample power for reverse movement of the vehicle.

Figure 6:
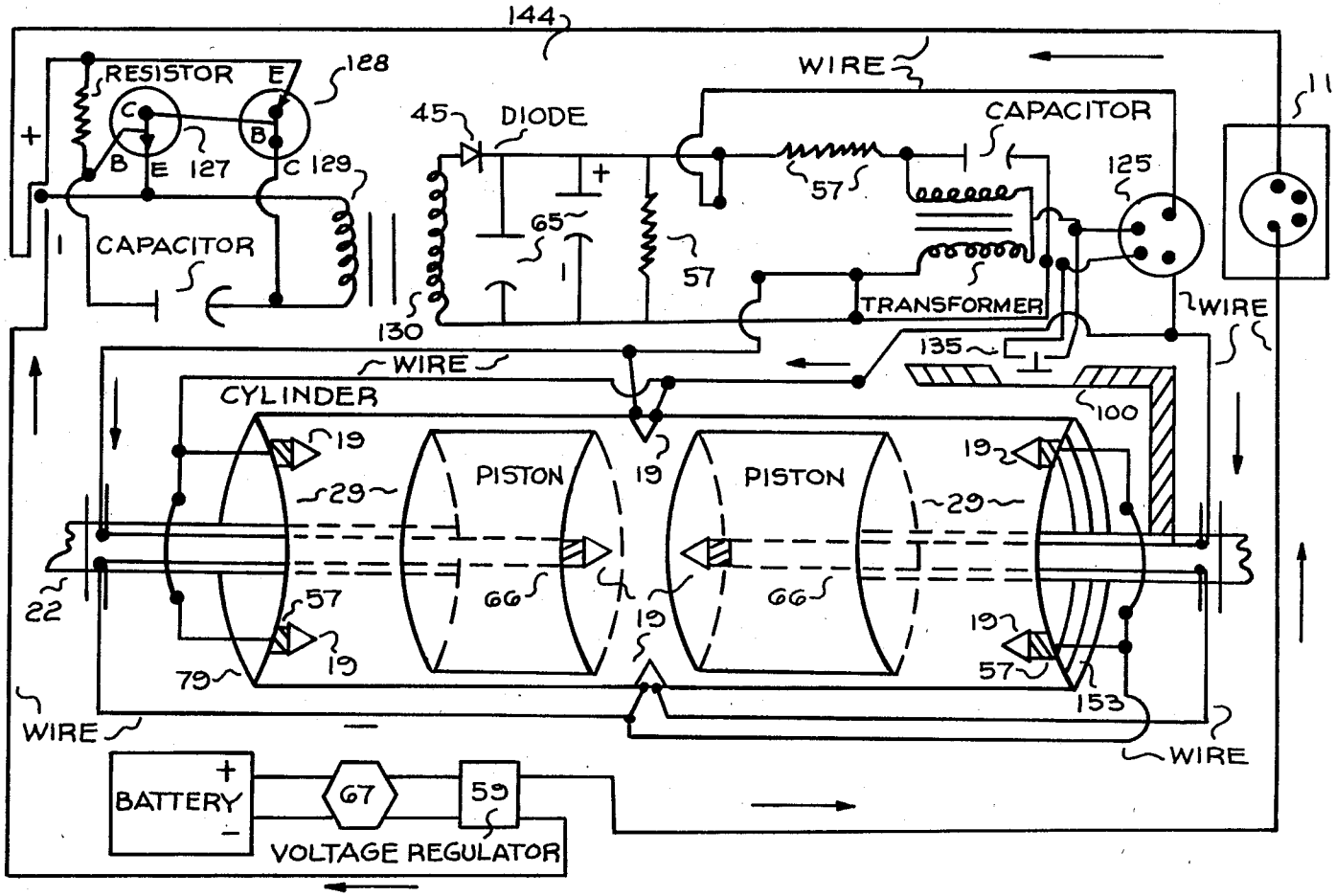
FIG. 6, is a schematic drawing of the cylinder showing the electrodes therein for heating the compressed air for operating the pistons therein and the AC-DC converter for generating high voltage for arcing the electrodes.

FIG. 1, the air cylinder has two double acting pistons working inside as described in FIG. 6. In FIG. 1, two piston rods 22 are shown at each end 79 of the cylinder that drive the two connecting rods 3 when compressed air is expanded inside the cylinder or the two piston rods 22 are driven by the connecting rods 3 when the air cylinder is converted to a compressor when the FIG. 4 electric solenoid valve 61(*b*) in air line 17 is closed for the flow of compressed air to the cylinder and exhaust gases 134 and ambient air is drawn into the cylinder when valve 95 is opened. (This is fully explained in FIG. 4).

FIG. 1, during vehicle deceleration, the vehicle wheels turn the drive train shaft which rotates the pulley thereon in driving a belt to a second pulley connected to the output shaft (Fully explained in FIG. 2) of the air cylinder. FIG. 1, the rotating output shaft rotates the main gear which in turn rotates the two secondary gears 1 which in turn drive the crank arms in reciprocating motion that drive the two connecting rods 3 and 4 in a reciprocating motion which drive the piston rods to the pistons in the cylinder in compressing air for storage and later use. As explained in FIGS. 4 and 5, the cylinder also compresses air during braking of the vehicle.

FIG. 1 shows a gear rack that is fixed to a control arm 100 and that is adapted to the piston rod 22. The gear rack is meshed to three gear valves on each side of the cylinder. The gear valve comprises a spur gear that is fixed to a rotatable stem that is fixed to a valve body (not shown) that is adapted to each intake port and each exhaust port of the cylinder. There are three intake ports and three exhaust ports on each side of a cylinder. The openings to gear valves are arranged inside the intake and exhaust ports so that the timing sequence to the gear movement is for the three exhaust valves to close when the three intake valves are open and vice versa. And the valves open and close in this sequence as the gear rack moves back and forth in unison with the movement of the piston rod 22, regardless of whether the cylinder is expanding or compressing air because, as explained in FIGS. 4 and 5, valves in the air lines leading to the cylinder control the input of ambient or compressed air.

Figure 5:
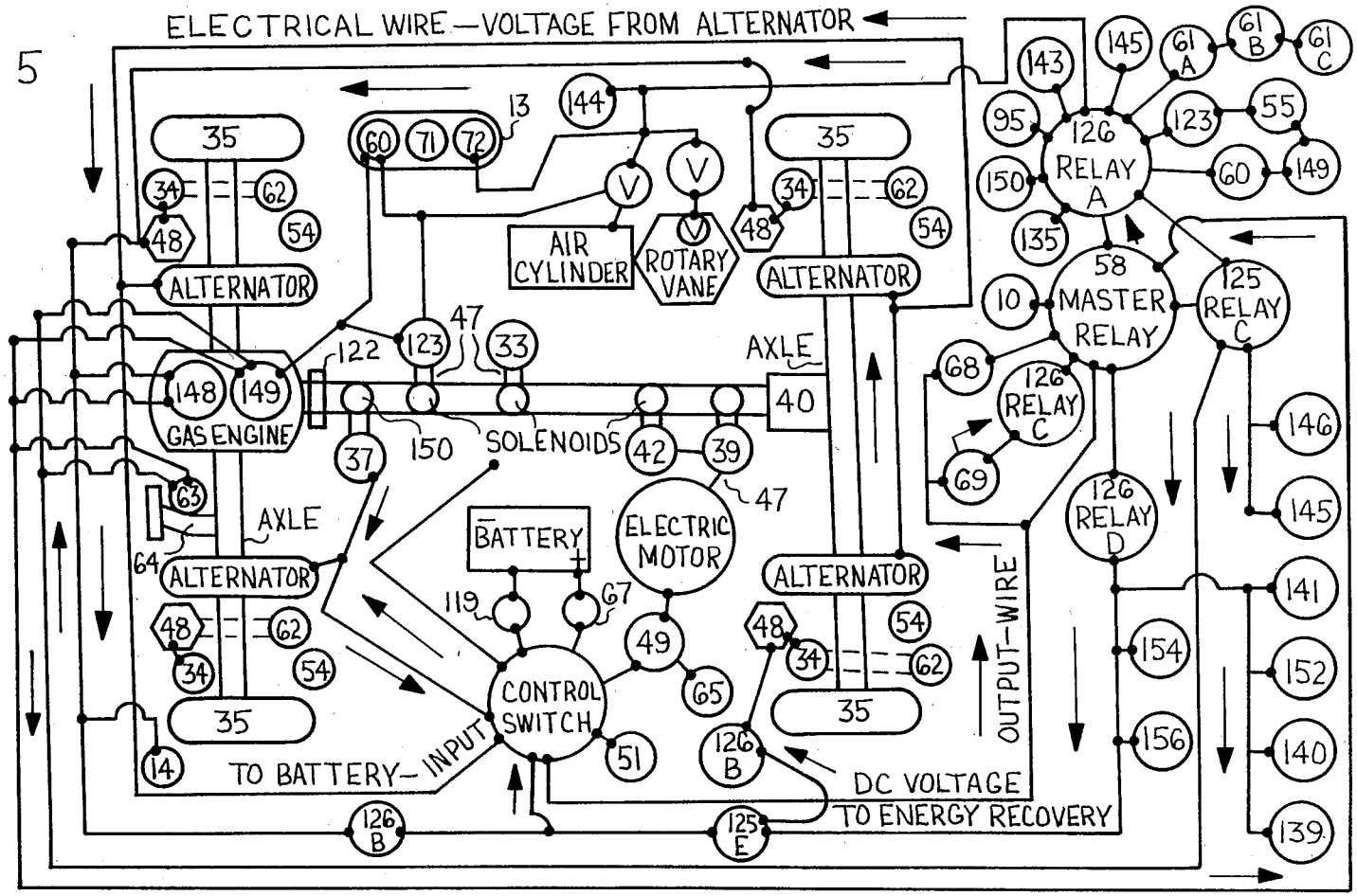
FIG. 5, is the schematic drawing of the electrical monitoring system. It shows the electrical wiring and location of the relays, solenoids, control switches, relays, electrical switches, and components to the vehicle and for operating the kinetic energy recovery system and the hot gas engine and rotary vane in relation to the gasoline or diesel engine.

FIG. 1, a second and optional method for operating the valves to the cylinder as explained in FIG. 5, is by the application of electric solenoids (not shown) adapted to the cylinder and to the valve stem and an electrical proximity or pressure switch (not shown) making contact to the control arm 100 that would electrically open and close valves in sequence. Applying the second method offers greater speed over the mechanical gear rack method and its application would be more advantageous were the engine to be operated at high speed, though the cost for adaptation and maintenance would be much greater than for the first method.

FIG. 1, the gear rack that is fixed to the control arm 100 slides in a rail (not shown) that is mounted to the outer surface of the air cylinder. Also mounted to the outer surface of the air cylinder is a plurality of electric heat grids 10 and electric heat coils 78 that are insulated from the metal surface. FIG. 5 fully explains the application of the heat grids and coils.

FIG. 2, is a side view of the air cylinder, connecting rods 3 and 4 and the crank arms to the secondary gear 1 and the main gear 12. The main gear 12 fixed to the output shaft 8 having a pulley and belt connected to a second pulley that is fixed to the vehicle drive shaft. When the clutch mechanism is engaged by the electric solenoid 48 either the output shaft can drive the drive shaft or vice versa. Loading the cylinder with compressed air causes the piston rod 22 and mounting swivel 23 to drive the connecting rods 3 and 4 in a reciprocating motion to the bearing 77 and to the crank arms 5 and 7 in rotating the secondary gear 1 and shaft 6 to a bearing 77 that is adapted to a bearing mount. The secondary gear 1 in turn drives the output shaft 6. Simultaneously, exhaust gas expelled from the cylinder FIG. 1, and gasoline or diesel engine through gear valves is transmitted through an air line FIG. 2, through a nozzle 16 into the fan cup pockets 26 (not shown) that are fixed to the outer end of a series of fan blades 25 that are fixed at the center to the output shaft 8 so that the pressure of the exhaust gases act against the fan cup pockets 26 in driving the fan blades 25 in an air tight and closed casing to a rotary vane which in turn drives the output shaft 8 that rotates the pulley and belt for driving the vehicle drive shaft.

FIG. 2, on braking or deceleration of the vehicle, the cylinder and rotary vane are loaded with ambient air and exhaust gases from the gasoline or diesel engine (explained in FIG. 4) and the vehicle wheels transmit power to the drive shaft in rotating the pulley and belt in driving the pulley to the output shaft 8 as the solenoid is energized for engaging the clutch mechanism. (Fully explained in FIG. 5) The output shaft in turn drives the gears and connecting elements in driving the pistons for compressing air in the cylinder and simultaneously the fan cup pockets 26 to the rotary vane compress air as the blades are rotated by the output shaft 8. FIG. 2, a main bearing 77 is mounted at either end of the output shaft 8 and to the outer housing 30 as is a bearing and mount for the secondary gear shaft 6. Either a gear or a pulley and belt can be fixed to the secondary gear 1's output shaft 6 and the two secondary gears 1, without meshing to the main gear 12, as shown in FIG. 1 and FIG. 2, could serve as timing gears and the second gear or pulley to the shaft 6 could be the drive element.

The inner housing 31 houses the gears and crank arms and is a holding area for lubricant to these operating elements. Expanded air and gas is constantly recirculated and recompressed by the rotary vane, the air cylinder and the satellite compressors (FIG. 4). Each cylinder within the engine can have a specific purpose and function for acceleration but during braking or deceleration, with the exception of the reverse gearing arrangement, can operate as one unit in the recovery of kinetic energy. The cylinders to the engine can be either round or square and a multiplicity of cylinders can be adapted to one set of connecting rods and secondary gears, all driving one output shaft, as can a series of different operating cylinders be arranged to one output shaft.

Figure 3:
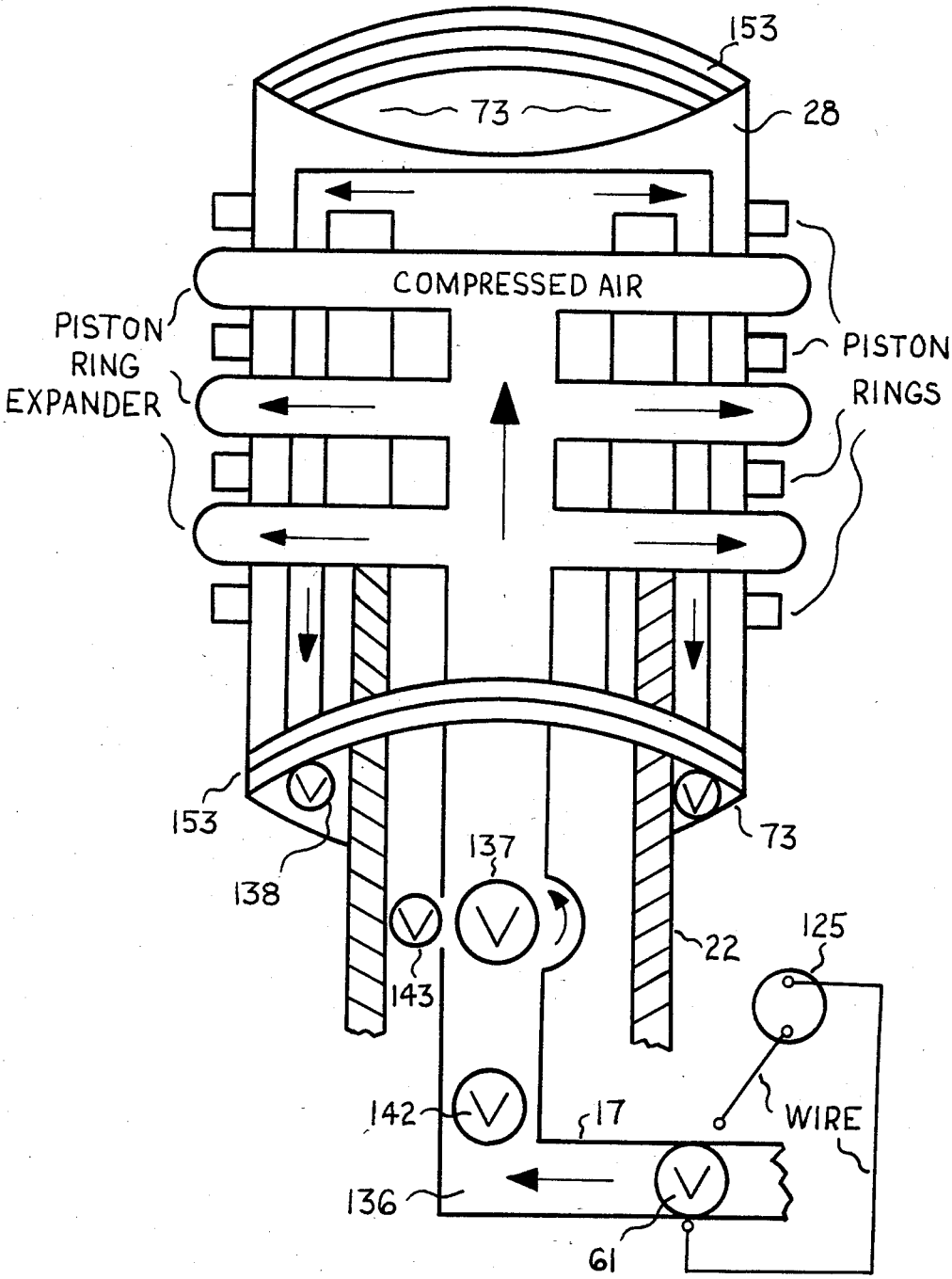
FIG. 3, is a drawing of the piston and the input lines and valves therein for controlling the flow of compressed air for cooling the inside of the piston during operation and also for the flow of compressed air to the piston expanders for sealing the piston rings and the cylinder wall between the compression and expansion spaces therein.

FIG. 3, is a drawing showing a piston 28 having threads 153 inside and outside the piston head 73 located at each end of the piston 28. In circumference to the outside of the piston 28 are a series of piston rings equally spaced apart and having there between and in circumference to the outside of the piston 28 are a series of piston ring expanders that are made of a flexible material such as rubber that expands as compressed air is fed to it from openings inside the piston 28 and that seals off the air between the working piston 28 and the inside cylinder wall. Also compressed air is fed through a ball valve 137 inside an opening in the piston rod 22 to a series of open channels inside the piston 28 for cooling it during operation and the compressed air is released through a pressure ball valve 138 (common to the industry) at the piston rod 22 end of the cylinder 73 that is passed into the compression and expansion space inside the cylinder as working fluid. Compressed air to the piston 28 is released from storage when solenoid valve 61(*b*) is opened by impulsing of relay 125 and is transmitted through air line 17 to FIG. 3 and FIG. 4, first solenoid valve 142 at the piston rod 22 that is the control valve for ball valve 137 and also for a second electric solenoid valve 143 that opens when energized for the passage of compressed air to the channels inside the piston 28. As air expands when heated and condenses when cooled, for the successful operation of such an engine it is very important that these two factors be regulated and controlled so that the maximum efficiency can be attained. The difference between these two factors as applied during operation of the cylinder determines the amount of work that can be performed, and they should be controlled at the point of operation. FIG. 1, heating coils and heat grids to the outside of the cylinder, and also to air lines and storage tanks can maintain a high temperature for the expansion of air, FIG. 6, as well as having heat electrodes inside the cylinder for heating the compressed air during the maximum stroke of the piston. Heat loss to the piston can reduce efficiency.

FIG. 4, is a diagram of the compressed air recovery, supply and storage system for the Hot Gas Engine. FIG. 4 shows a compressor that is mounted and fixed to the axle of a wheel. The compressor is operated simultaneously with the alternator and hydraulic pump and in the same manner as fully explained in FIG. 5. FIG. 4, the compressor compresses ambient air from air induction fans 14 that are adapted to the airline at the compressor and also exhaust gases 134 are fed to the compressor from the rotary vane. The compressed air recovery system is a closed circuit recirculating system and with the addition of exhaust gases 134 from the gasoline or diesel engine and the hot gas engine. Compressed air is fed from the compressors at the wheel through airline 36 to a transducer generator 123 that senses the pressure in the airline (this is explained fully in FIG. 5) and the compressed air is then transmitted to a storage tank 13. In addition to the compressed air that is recovered by the compressors at the wheels, a compressor 33 is operated by the drive train shaft 151 (explained fully in FIG. 5) and mainly exhaust gas 134 from the air cylinder and the gasoline diesel engine that is transmitted through the rotary vane is released through electric solenoid valve 146 for compression and is transmitted to the transducer generator 123 for the sensing of pressure in airline 36 (this is explained fully in FIG. 5) and is then transmitted through airline 36 to storage tank 13.

FIG. 4, during acceleration of the air engine and the gasoline or diesel engine exhaust gases 134 are released through triple acting solenoid valve 61(*a*) to the airline leading to the intake port of the rotary vane which has a plurality of rotatable blades that are fixed at the center of the output shaft of the air engine (Explained in FIG. 2) and the pressure of the exhaust gases rotate the blades which provide auxiliary power to the air engine's output shaft. (Explained in FIG. 2)

Adapted to the throttle control arm (not shown) of the gasoline or diesel engine is an acceleration speed control switch (not shown but its operation fully explained in FIG. 5) and as the operator of the vehicle presses the accelerator pedal, the engagement of the throttle control arm automatically engages the acceleration speed control switch 149, that is wired to the electric monitoring system control panel (fully explained in FIG. 5) for release of compressed air from the storage tank 13. As explained in FIG. 5, the monitoring system automatically, upon acceleration of the air engine or gasoline or diesel engine, opens the double acting electric solenoid valve 61(*b*) for the release of compressed air to air line 17 for transmission of compressed working fluid to the intake ports at the air cylinder. Compressed air is released to air line 17 and fed through a second transducer generator 123 (as fully explained in FIG. 5) for the sensing of the air pressure in air line 17. The compressed air is then transmitted to a speed control valve 55 which is adapted to the air line 17 for controlling the speed of flow of compressed air through air line 17 (this is fully explained in FIG. 5) and the compressed air is then transmitted through air line 17 to a calcium chloride filter 124 for removing moisture from the compressed air which is then transmitted through coils 46 that are in a coolant tank 18 having either a liquid coolant such as water or anti freeze for cooling the compressed air before it is transmitted through two way valve 95 and to the intake ports of the air cylinder (this is fully explained in FIG. 1) for expansion of the compressed air in driving the pistons therein.

FIG. 4, during acceleration of the gasoline or diesel engine, the exhaust gases 134 are prevented from back pressuring through the engine by the application of a back pressure valve 104, which is a mechanical valve that is operated by one way pressure that allows for the transmission of the gas 134 in one direction only.

Adapted to the storage tank 13 are three valves; the air pressure release valve 71 which automatically releases excess air pressure from the tank, the condensation valve 72 which is an electric solenoid valve and is operated through the manual control switch by the vehicle operator for the release of condensation from the tank, and the pressure gauge sensor switch 60 which is an electric switch for sensing the preset and predetermined high and low pressure in the tank 13. (Its function and purpose is fully explained in FIG. 5).

FIG. 4, upon braking or deceleration of the gasoline or diesel engine, exhaust gases 134 are transmitted through electric solenoid valve 145 that is opened simultaneous to the closing of one side of three way solenoid valve 61(*a*) and the gases are transmitted through air line 17 and to coils 46 in a coolant tank 18 for cooling of hot exhaust gases 134 before transmission through valve 95 that is opened for the transmission of ambient air from the atmosphere and also for the transmission of the cooled exhaust gases 134 to the intake port of the air cylinder. The exhaust gases 134 and ambient air are compressed by the double acting pistons in the air cylinder and the compressed air is released (this is explained in FIG. 1) through exhaust ports to solenoid valve triple acting valve 61(*a*) which is opened for the transmission of compressed air to air line 36 and to the transducer generator 123 adapted to the air line (explained fully in FIG. 5) for sensing the pressure of the compressed fluid as it is transmitted to the storage tank 13.

FIG. 4, simultaneously upon braking or deceleration of the vehicle two way electric solenoid valve 61(*b*) is closed for the release of compressed air from the storage tank and also solenoid valve 61(*a*) which is a triple acting valve opens to one side for the entrance of ambient air to the rotary vane and for compression of air. Compressed air is released by double acting electric solenoid valve 146 to the air line 36 for transmission through transducer generator 123 and to storage tank 13, and valve 146 is closed for the transmission of compressed air through the air line to the satellite compressors. And simultaneously, during deceleration or braking of the vehicle, the compressors at each wheel are operated as the retractable gear 34 (this is explained fully in FIG. 5) is driven by the tire sidewall and the engaging of compressor 33 at the drive train shaft 151 (as explained in FIG. 5) for compressing air for storage. Ambient air is fed to the compressors by the air induction fans 14.

FIG. 5 is a diagram of the physical layout to a vehicle of the electrical wiring that comprises the monitoring system for the Hot Gas Engine and Vehicle Drive System. The monitoring system is the complete electrical circuitry that controls the operation of valves, clutch mechanism, the electric motor, sensors, transducers, potentiometers, transformers, relays, switches, solenoids, and all the electronic components for operating the air cylinders to the Hot Gas Engine, the electric motor, the satellite pump, alternator and compressor. The monitoring system is the complete control center for this invention and it is completely independent of the electrical system to the gasoline or diesel engine and the conventional electrical system of the vehicle, including the lighting system, ignition system, air conditioning, heating and all the electrical accessories.

FIG. 5 shows an alternator fixed to the axle of each wheel and tire 35 of a vehicle and at least one alternator 37 connected to its drive train shaft 151 by pulley and belt 47 for generating electricity during vehicle acceleration, braking and deceleration that supplies sufficient electricity for storage in batteries arranged in series and for operation of the monitoring system and the electric motor.

FIG. 5, either AC or DC current can be generated. The generated electricity is fed through a wire to a rectifier 119 for converting AC to DC current for storage in a series of batteries which are of sufficient capacity for storing DC current for the entire electrical monitoring system. Electricity is transmitted to a transformer 67 for conversion to 12 VDC or 24 VDC voltage for operation of the electrical circuitry with the exception of the electric motor which can be operated either by AC or DC current. Electricity is transmitted to a control switch from the alternator and alternating (AC) current can be transmitted directly to the electric motor after filtering through a step up transformer 49 for increasing the voltage output or it can rectified 119 and then transmitted from storage batteries as Direct (DC) current to the control switch for operating the electrohydraulic motor 39, as explained in FIG. 8.

FIG. 5, operation of the electrohydraulic motor 39 can be manually controlled by the operator of the vehicle by the setting of the control switch which is arranged to the dashboard of the vehicle in the operator's compartment (not shown). The control switch is connected to the automobile ignition switch 51 which has to be turned on first before the control switch and monitoring system is operable. The control switch is adjustable for automatic operation of the electrical monitoring system.

The electric motor, which can be of low horsepower, has high rpm but size and electrical power limitations make it impractical for providing sufficient power for driving a vehicle due to load requirements. However, by the combination of having the electric motor supply drive to the fluid hydraulics to a hydraulic motor 39 (common to the industry), sufficient torque and power is provided for driving a vehicle. Current drain to the electrical system is minimized with this type of arrangement although sufficient current still would not be available for long range application. The electric motor can be a gear motor which would reduce the rpm and also the electrical requirements and permit a smaller size motor for driving the fluid hydraulics to the hydraulic motor 39.

FIG. 5, shows the electrical wiring from the control switch to the electric motor and from the control switch to the electric solenoid that engages the clutch mechanism 47 to the belt drive that connects the pulley adapted to the hydraulic motor 39 for driving the pulley adapted to the drive train shaft 151 of the vehicle. This is fully explained in FIG. 8.

FIG. 5, two electric mercury switches 68 and 69 that are mounted to the frame of the vehicle for sensing its gradient position relative to the road during movement. Each switch is adjustable to a preset and predetermined position to the vehicle for providing sensitivity to its position. Mercury switch 68 is sensitive to the vehicle's forward position in the decline, as when traveling down a grade or hill and makes electrical contact when the vehicle is in this position. Mercury switch 69 is sensitive to the vehicle's position in the incline and makes electrical contact in this position.

FIG. 5, Electrical switch 63 is a pressure of proximity switch that is adapted to the brake pedal 64 of the vehicle and is energized when pressure is applied to the brake pedal 64. Electrical switch 148 is located to the back throttle plate to the carburetor of the gasoline or diesel engine and is a pressure sensitive switch that is energized when the throttle control arm to the accelerator pedal (not shown) of the vehicle is released.

FIG. 5, at least one electric solenoid 48 of the pull type is mounted to the axle (as explained in FIG. 9) at each wheel of the vehicle and when energized pulls the retractable gear 34 against the tire sidewall as it rotates. As the retractable gear 34 rotates it drives a second gear and shaft 62 that is connected to a gear box 54 having a shaft for driving three pulleys and belts 52 connected to the pulley and shaft of the satellite alternator, hydraulic pump and compressor in the recovery of kinetic energy. (This is explained in FIG. 9).

Electric switch 10 is wired to the electric heat grids and coils (FIG. 1), FIG. 5, for heating the storage tank 13, the air cylinder and air lines. Electric switch 135 (as shown in FIG. 6) is fixed to the control arm 100 that moves with the piston 73 and makes electrical contact for the firing of electrodes 19 for the heating of compressed air and expanding it in the expansion chamber 29 of the cylinder. FIG. 6, a AC-DC Converter 144 having at least two transistors 127 and 128 that supply voltage from a battery 44 to a step up transformer having coils 129 and 130 and through a series of diodes 45, capacitors 65 and resistors 57 to a trigger transformer 131 for impulsing a high voltage spike that is transmitted through a relay 58 and through wires 66 that pass through an opening in the piston rod 22 through the threaded 153 end of the cylinder 70 to a plurality of electrodes 19 and to electrodes at both ends of each piston 73 for heating the compressed air.

Figure 7:
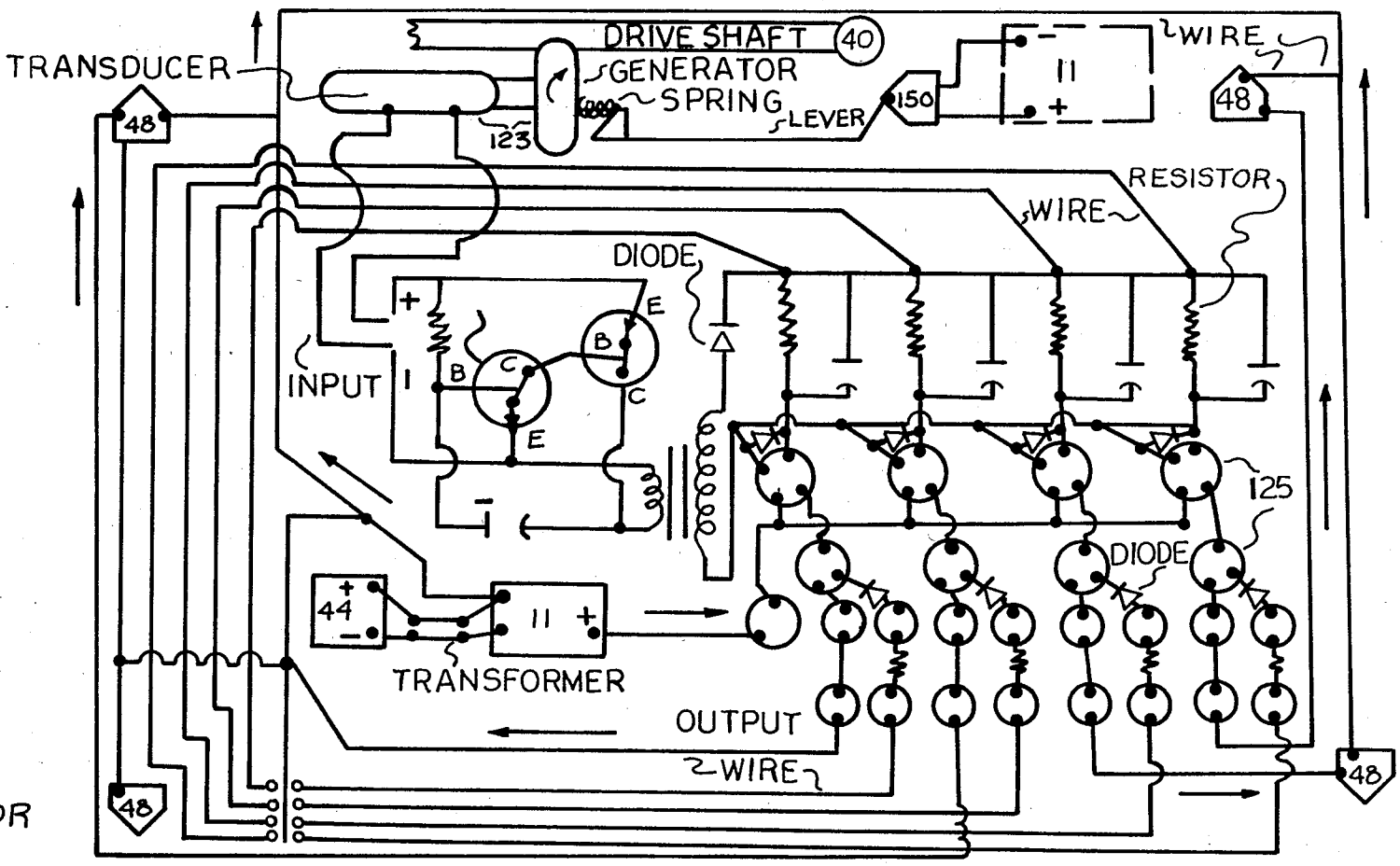
FIG. 7, is a schematic drawing of a transducer generator oscillator for providing intermittent voltage to the electrical solenoids for operating the kinetic energy recovery elements at the vehicle wheels and also the DC generator at the drive shaft for generating variable current that can be transduced by electrical components in the monitoring system.

FIG. 5, FIG. 4, and FIG. 7 shows a transducer generator 123 adapted to the drive train shaft 151 connected to the rear drive unit 40. The transducer generator 123 comprises a small DC generator having a spring loaded rotatable gear and shaft adaptable to the drive train shaft 151 by a pull type electric solenoid 150 that is energized by Relay 126A (FIG. 5). The DC generator generates a small amount of direct current in proportion to the speed of rotation of the drive train shaft 151, and this electrical current is transduced by a potentiometer (not shown) and fed by wire to a DC oscillator FIG. 7 that comprises two NPN transistors 127 and 128 passing current to a step up transformer coils 129 and 130, a series of resistors 57, diodes and capacitors 65 for the sequential and intermittent operation of the four electric solenoids 48 by energizing the coils to a series of relays 125 that transmit 24 VDC from storage batteries 44 through transformer 67 to electric solenoids 48 at wheels tires 35 of vehicle.

FIG. 5 and FIG. 4 shows electric solenoid valves 61(*a*), 61(*b*), 61(*c*), 55, 72, 95, 142, 143, 145 and 146 that are adapted to the air lines 17 and 36 at the satellite compressors 33, the rotary vane, the storage tank and the air cylinder for the input and output of working fluid in the closed circuit circulating system. These electric solenoid valves are wired to relays 126A at the electric control panel and are operated automatically with the exception of valve 72 which is operated manually by the operator of the vehicle for removing condensation from the storage tank. The operation of these electric solenoid valves will be discussed subsequently, and their physical location to the air lines and their function is described fully in FIG. 4.

FIG. 1, FIG. 6 and FIG. 5, electric solenoids 139, 140, 141 and 152 (not shown) are pull type solenoids that can be adapted to gear valves as shown in FIG. 1 by replacing the gear rack for opening and closing valves by mounting the solenoids (not shown) to the air cylinder and having a rod connection (not shown) for opening and closing the valves. These electric solenoids can be electrically operated through relay 125C which is explained more fully later.

FIG. 5 shows a storage tank 13 having a pressure gauge sensor switch 60 that senses a high and low pressure in the storage tank for determining and controlling the requirement for air pressure that is needed for operating the air cylinder. The pressure gauge sensor switch 60 is wired to a first transducer 123 adapted to air line 36 for transducing the air pressure that is generated by the satellite compressors and fed to the storage tank and is wired to a second transducer 123 adapted to the compressed air line 17 leading to the air cylinder for transducing the air pressure that is transmitted for operating the air cylinder. The transducers comprise a rod shaped paddle that is mounted to a swivel and swings freely inside the airline 17 and 36 (as shown in FIG. 4), the other end to the outer surface of the air line is connected to a sliding potentiometer (not shown) that is wired to at least one DC generator 123 that is driven by the drive train shaft 151 (as previously explained). The movement of the paddle in the compressed air line also moves the resistance to the potentiometer as current is fed from the DC generator 123. A high resistance of the potentiometer is proportionate to a high pressure in the compressed air line and vice versa. As DC current is fed to the sliding resistor, its output of electrical current will vary according to its resistance as transduced at the air line. It is wired for electrical output to the transducer oscillator and also to the acceleration speed control switch 149 (fully explained later) for controlling the intermittent speed of recovery of compressed air for operation of the air cylinder during its acceleration by either increasing or decreasing the flow of current fed to oscillator 144 which either speeds up or slows down the electrical impulsing for energizing the relays 125 that feed current to the electric solenoids 48 that engage the retractable gear 34 for operation of the air compressors at the vehicle tire and wheel 35.

The acceleration speed control switch 149 (not shown) is adapted to the throttle control arm of the gasoline or diesel engine and to the speed control rod 122 for the time sharing of power between the two different engines by controlling and regulating the flow of compressed fluid to the air engine and coordinating this flow with the recovery of kinetic energy. It comprises a sliding potentiometer, a transducer and electrical switching circuitry and receives current from the battery through relay 125C. The transducer comprises a mechanical connection between the throttle control arm (not shown), the speed control rod 122 (explained later on), and the potentiometer and its transduces these movements into electrical impulses for transmission through wires to the speed control valve 55, the transducer generator, 123 and the pressure gauge sensor switch 60. The speed control valve 55 is an electric solenoid valve (common to the industry) that is electrically opened and closed in degrees according to the amount of current it receives from the acceleration speed control switch 149. It controls the speed of operation of the Hot Gas Engine by regulating the flow of compressed air to the air cylinder, and it also is the shut off valve for stopping the engine from operating when electrical current is not transmitted from the acceleration speed control switch 149, which transmits current in proportion to the resistance at the potentiometer. No current is transmitted under the following conditions: (a) the control switch is turned off (b) a low pressure signal is transmitted from the pressure gauge sensor switch (a) a low current or no current is transmitted from the transducer generator 123 at the air line 17 or 36 (a preset and predetermined factor).

FIG. 5, The speed control valve 55 is a variable electrical conductance valve that receives current from the sliding and adjustable potentiometer (not shown) part of the acceleration speed control switch 149 which increases or decreases current according to the movement of the throttle control arm (not shown) of the gasoline or diesel engine and the kickdown arm (not shown) of the hot gas engine. The acceleration speed control switch 149 comprises an adjustable kickdown arm, (not shown) similar to the standard kickdown arm to the carburetor of a gasoline or diesel engine, that is adapted to the throttle control arm (not shown) of the carburetor, allowing for operator foot control at the accelerator pedal (not shown) for engaging or disengaging the acceleration speed control switch 149 for operation in time sharing of power between the two engines.

FIG. 5, the kickdown arm (not shown) allows for operation of the hot gas engine when the gasoline or diesel engine is inoperable or its carburetion is at an idle as the accelerator pedal's (not shown) movement is directed to the kickdown arm (not shown) and not the throttle control arm (not shown) when it is disengaged.

FIG. 2, In order for the output shaft of the gasoline or diesel engine and the output shaft of the hot gas engine to be synchronized and turning at the same time and at the same speed of rotation before one engine overrides the other or becomes the dominent drive force at any speed, or both engines to operate to a time sharing of power and in unison, the least non operating engine's output shaft must match the speed of rotation to that of the dominent engine's output shaft (as shown in FIG. 2).

FIG. 5, this is accomplished by the synchronization of the speed control rod 122 to the acceleration speed control switch's 149 sliding potentiometer (not shown). The speed control rod 122 is selectively adapted to a swivel (not shown) that is mounted to a fixed mechanism at the output shaft or the drive shaft of the gasoline or diesel engine. Said speed control rod 122 can move freely to either end of said swivel (not shown), one end has a roller (not shown) that rides freely against said output shaft and the other end extends to the acceleration speed control switch 149 in a position that its movement intersects to the same plane and the action of the output shaft to the speed control rod 122 against the roller (not shown) induces a reciprocating movement in proportion to its speed of rotation.

FIG. 5, the movement of the speed control rod 122 trips a pressure sensitive electrical switch (not shown) which is part of the acceleration speed control switch 149 and is wired for receiving and transmitting electricity to and from Master Relay 58 that is transmitted to the sliding potentiometer (not shown) for supplying variable voltage to the speed control valve 55, as the speed control rod 122 that is adapted to the kickdown arm (not shown) and moves the slide arm to the potentiometer (not shown) back and forth for applying resistance to the current according to its rotational speed at the output shaft. When the gasoline or diesel engine is inoperable and the hot gas engine drives the vehicle, the kickdown arm (not shown) to the accelerator pedal (not shown) and throttle control arm (not shown) moves the sliding arm to the potentiometer (not shown) back and forth which serves as a voltage feed unit to the speed control valve 55 for supplying a volume of pressure to the air cylinder.

FIG. 5 and FIG. 4, Simultaneously, the tripping of the pressure sensitive switch (not shown) to the acceleration speed control switch 149 causes the Master Relay 58 to energize the contracts to relay 126A for energizing FIG. 4 solenoid valve 61(*b*) for releasing compressed air from storage tank 13 and opening solenoid valve 95 for the input of compressed air to the FIG. 1 input gear valve at the air cylinder. FIG. 4, also solenoid valve 61(*a*) is opened for receiving exhaust gas from the gasoline or diesel engine and hot gas engine to the rotary vane as the gear valve to the output port of the cylinder is opened. Also solenoid valve 146 is opened for the transmission of exhaust gases from the rotary vane through an air line to the satellite compressors for the compression of air. (FIG. 4)

FIG. 5, The acceleration speed control switch 149 serves as a comparator to the feedback of electrical impulses from the transducer generator 123 (described in FIG. 4) and it has a preset and predetermined calibration for voltage/current. For automatic electrical control for equalizing speeds of rotation of two different output shafts the select transduced electrical operating voltage that is generated by the Transducer generator 123 can be a split voltage, as there are at least two transducer generators 123 to the compressed air line 17, one to either side of the speed control valve 55, and any drop or increase in said voltage can be compensated for by a voltage divider or amplifier and the preset and predetermined settings to the acceleration speed control switch 149 is a constant factor and is equalized by the constant electrical feedback from the two transducer generators 123. (FIG. 4)

FIG. 4 and FIG. 5, In time sharing of power the feed control to both engines is a constantly changing factor and the hot gas engine is the least dominant and when the engines are accelerated by the kickdown arm (not shown) and throttle control arm (not shown), the potentiometer (not shown) at the acceleration speed control switch 149 will transmit a higher voltage to the speed control valve 55 for the release of more compressed working fluid to the hot gas engine. However, the voltage feedback from the two transducer generators 123 must be high enough to indicate sufficient air pressure in line 17 and if adequate voltage is not supplied to the potentiometer (not shown), voltage will be dropped by the acceleration speed control switch 149 through the wire to the Master relay 58 which will automatically close solenoid valve 61(*b*) so that compressed air can build up for storage by the transducer generator 123 (FIG. 7) supplying current to the DC oscillator that switches on the solenoids 48 for engaging the FIG. 9 and FIG. 4 retractable gear at the wheel for the satellite compressor to compress air for storage.

FIG. 5, Master relay 58 through the control switch is the switching relay and electrical control for all the switches and relays to the circuitry, including relays 125C, 126D, 126A, 126B, 126C and 125E, and during braking of vehicle or deceleration, mercury switch 68 is energized and transmits an impulse to relay 58 that impulses relay 126D and 125E for the energizing of solenoid 48 (FIG. 5) (FIG. 4 and FIG. 9) and FIG. 5 also the clutch mechanism 154 to hot gas engine and clutch mechanism 156 to satellite alternator 33, hydraulic pump 42 and compressor 33 at the drive shaft for recovering kinetic energy. FIG. 4 and FIG. 5, valves 95 and 61(*a*) and 145 are energized and opened for ambient air and exhaust gas to air cylinder and rotary vane and three way valve 61(*a*) also opens for output of compressed air to storage tank as is valve 61(*c*) and valve 146. Current to electric heat grids 10 FIG. 1 and FIG. 5, and to switch 135 (explained in FIG. 6 and FIG. 5) for energizing of electrodes for heating the cylinder is deenergized.

FIG. 5, When the vehicle is on an incline, all operating switches, solenoids, valves and operating elements for kinetic energy recovery are deenergized and non operable when mercury switch 69 is energized, and through relay 126C deenergizes the switching contacts at Master relay 58 for those components. However, the electric motor can be operated by the manual control switch, and the air engine can provide auxiliary power.

The deceleration switch 148 is a pressure sensitive switch that is adapted to the back plate of the throttle control arm and performs the same function as the forward mercury switch 68 as described previously, and is energized when the engine's throttle is reduced. The brake pedal 64 has a pressure sensitive switch 63 adapted to the brake pedal arm that is energized when the brake pedal is pushed and it serves the same function as the forward mercury switch 68 as described previously and also the deceleration switch 148.

Figure 8:
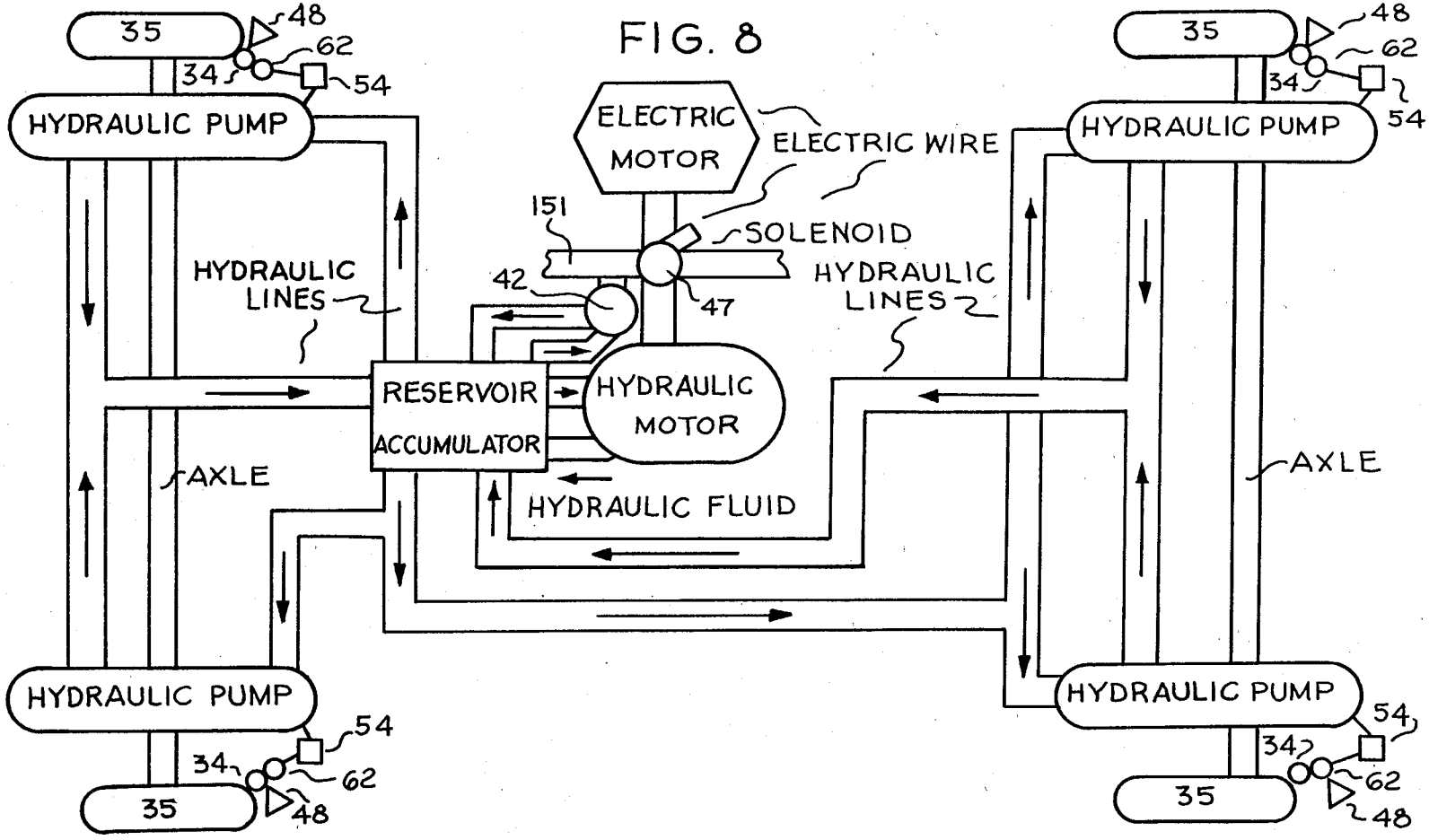
FIG. 8, is a drawing of the fluid hydraulic recovery system and it shows the supply lines for storage and for the hydraulic motor operated by the electric motor.

FIG. 8 is a diagram of the hydraulic system which shows a satellite hydraulic pump adapted to each tire 35 in the same manner as previously explained in FIGS. 4 and 5 for the alternators and compressors. A satellite hydraulic pump is also adapted to the drive train shaft 151 in the same manner as previously explained in FIGS. 4 and 5 for the alternators and compressors. The hydraulic fluid is pumped through a hydraulic line to a reservoir for storage and also to a hydraulic motor which is coupled to and driven by an electric motor that is wired to the electric control panel. The hydraulic motor is engaged and operated only when the electric motor is energized, as is fully explained in FIG. 5 that covers the electrical system. The electrohydraulic motor serves as auxiliary power to the gasoline or diesel engine and to the air cylinders and is not used for recovery of kinetic energy. A belt and pulley is connected between the hydraulic motor and the electric motor and also between the drive train shaft 151 and the hydraulic motor and one clutch mechanism 47 (common to the industry) engages both pulleys and the hydraulic motor drives the drive train shaft 151 when the electric solenoid is energized and engages the clutch mechanism. The hydraulic fluid in the reservoir serves as storage for hydraulic fluid and for the hydraulic motor and hydraulic pumps and also for the hydraulic braking and power steering system to the vehicle (not shown) by connecting hydraulic lines between the units and the necessary pressure valves, (not shown) particularly during an emergency or when the air operated engine is the one source of power for driving the vehicle and the gasoline or diesel engine is inoperable. The electrohydraulic motor could be used in the same circumstances for powering the vehicle, but would not be used as a power source when the gasoline or diesel engine is being used as the primary power for driving the vehicle. The size of the motors that could be used would depend upon the available AC or DC current for operation of the electric motor. And the electric motor, as explained in FIG. 5, would be operated by the driver of the vehicle through manual control of the control switch that would be adapted to the dashboard or driver's compartment of the vehicle. And the same switch controls reverse drive to the electric motor (FIG. 5) that drives the hydraulic motor in reverse and for reverse movement to the vehicle when the gasoline or diesel engine is inoperable.

Figure 9:
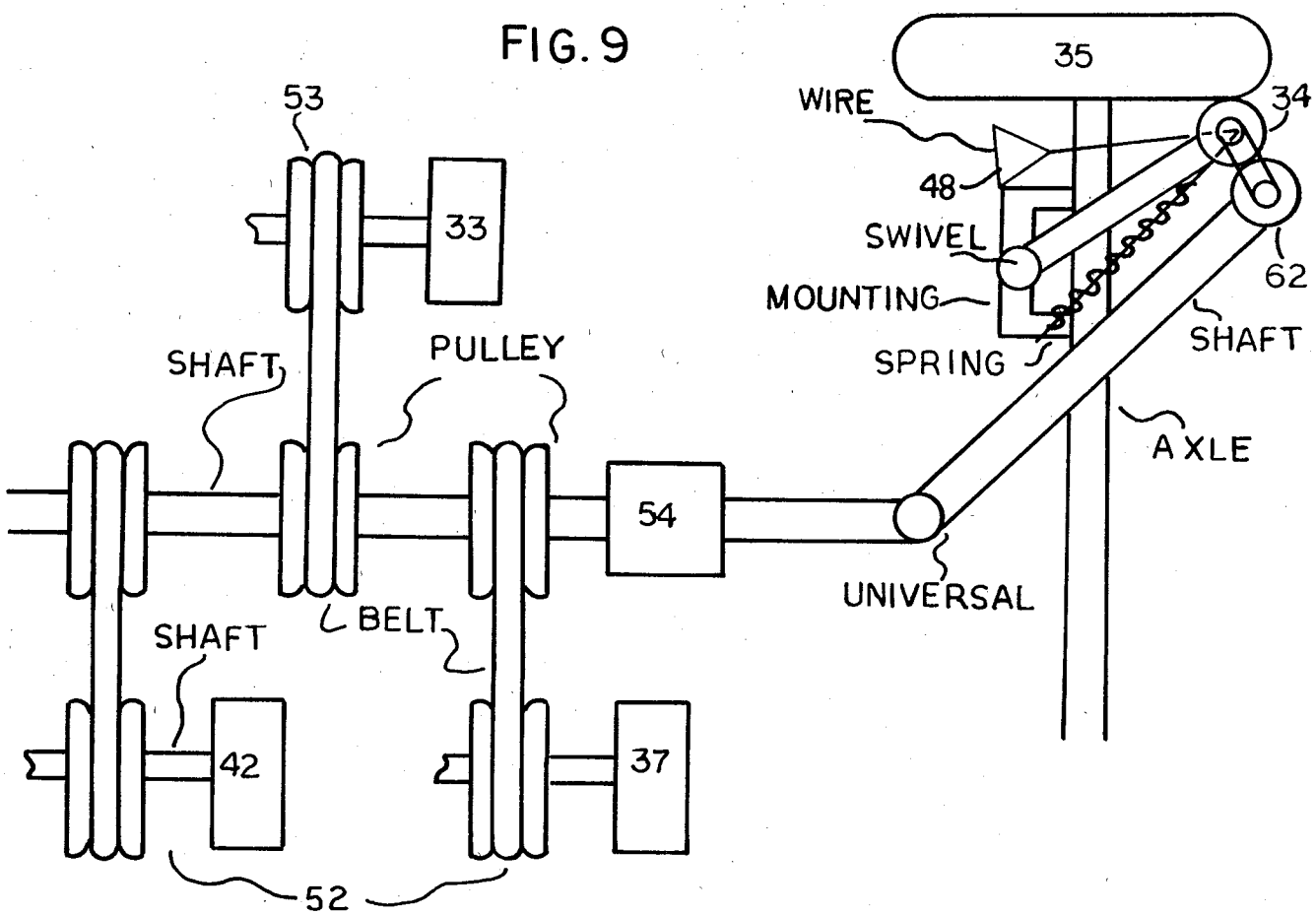
FIG. 9, is a drawing of the operating elements at the vehicle wheel for the operation of an air compressor, a hydraulic pump and alternator for recovering kinetic energy.

FIG. 9 and FIG. 5 show the vehicle tire 35 mounted to a wheel having an axle. Mounted to the axle is a swivel connected to a rod that extends to a second swivel that is adapted to the center of the retractable gear 34. FIG. 9, the retractable gear 34 is spring loaded having a spring which is fixed and extends from the gear 34 to the mount at the axle and pulls the retractable gear 34 away from the upper tire sidewall 35 when an electric solenoid 48 is not energized. The solenoid 48 is adapted to the mount at the axle and has an arm that extends to the retractable gear 34 and when energized it pulls it against the upper tire sidewall 35 for rotation and in driving a second gear 62 when the vehicle is in motion. The second gear 62 is fixed to a shaft having a universal joint that extends to a gear box 54 that supplies gear reduction for an output shaft having pulleys and belts for driving a pulley connected to the shaft of a satellite air compressor 33 for compressing air, a hydraulic pump 42 for pumping hydraulic fluid and an alternator 37 for generating electricity for storage.

The invention claimed is:

1. An apparatus for providing auxiliary power and braking to a vehicle including an electric monitoring system for the automatic control of said auxiliary power and braking and for the recovery of kinetic energy comprising:

(a) a vehicle having at least one tire and wheel and a drive shaft;

(b) an engine connected to said vehicle for powering said vehicle and including an electrohydraulic motor, an air cylinder with operatively connected elements and including an output shaft and having a rotary vane connected to said output shaft, said electrohydraulic motor and said air cylinder being operatively connected to said drive shaft of said vehicle;

(c) at least one hydraulic pump, at least one compressor and at least one alternator operatively connected to said tire and to said drive shaft of said vehicle and including means for the recovery of kinetic energy;

(d) means for braking said vehicle including means for loading said air cylinder, said rotary vane, said hydraulic pump, said compressor and said alternator and therefore said drive shaft of said vehicle;

(e) a closed circuit circulating system for compressed air and hydraulic fluid and including means for storing said air and said hydraulic fluid;

(f) means for recovering kinetic energy of said vehicle including means for the automatic electric switching of electronic components for regulating and controlling the auxiliary power and the kinetic energy recovery equipment including;

at least one mercury switch for sensing the gradient position of said vehicle, at least one sensor switch for determining the air pressure in said closed circuit circulating system and in a storage container, a series of batteries for storing electricity, a master control switch for automatic or manual control of said monitoring system, a series of relays and switches and including at least one master relay for the automatic switching of voltage, a series of resistive electrodes for heating of compressed air, a DC oscillator for the intermittent switching of series of electric relays, at least one DC generator connected to said drive shaft for generating direct current that is fed to a potentiometer for variable voltage output, at least one potentiometer for providing variable voltage to a series of switching relays, an AC-DC converter for providing voltage to said resistive electrodes, at least one electric solenoid valve adapted to said closed circuit circulating system for regulating the flow of air therein, at least one electric solenoid operatively connected to a retractable gear at tire of said vehicle for driving said alternator, said compressor and said hydraulic pump in the recovery of kinetic energy, a series of electric solenoids operatively connected to a series of clutch mechanisms that are operatively connected to a series of pulleys and belts that are operatively connected to said output shaft and to said drive shaft, a pressure sensitive switch adapted to the brake pedal of said vehicle for electric switching of monitoring system during braking of said vehicle.

2. The apparatus according to claim 1 said means for using recovered kinetic energy in said closed circuit circulating system including at least one air cylinder for compressing and expanding air and said cylinder being operatively connected to elements for driving an output shaft, said air cylinder having working spaces therein for the compression and expansion of air, and said cylinder having at least two double acting pistons therein for the compression and expansion of said air, a series of intake and exhaust ports adapted to said air cylinder for the flow of air in said closed circuit circulating system, each said port adapted with a gear valve for selectively opening and closing said port, each said gear valve operatively connected to at least one rack gear for rotation of said gear valve, said rack gear operatively connected to a piston rod for movement thereof, each said piston having a piston rod connected at one end to the first end of a connecting rod for movement thereof, each said connecting rod intersect means adaptation to a bearing and shaft at a selectively adaptable position at equal distance from said piston rod and for reciprocating movement thereto, connected to the second end of each said connecting rod means a shaft and bearing is a crank arm for driving a rotatable gear, connected means bearing and shaft to the center of said crank arm and to a shaft and bearing to said connecting rod at right angles to said crank arm is a crank arm guide, the other end of said crank arm is adapted means bearing and shaft to a rotatable gear, said rotable gear is fixed at its center to a rotatable shaft that is adapted to a bearing and mount that is fixed to a supportive housing, said rotatable gear is connected to a second gear fixed to said output shaft and for driving said output shaft, said output shaft is connected means pulley and belt to said drive shaft of said vehicle for providing auxiliary power for said vehicle during acceleration and for the recovery of kinetic energy during braking, a rotary vane is adapted to said output shaft for using kinetic energy in rotating said output shaft.

3. The apparatus according to claim 1 having an electric monitoring system comprised of electronic components for controlling the selective operation of kinetic energy recovery and auxiliary power equipment:

a master control switch mounted to the operator's compartment of said vehicle for either manual or automatic control of said monitoring system that is wired to at least one alternator for the input of electricity to a series of storage batteries for providing direct current to said monitoring system wired to an electric motor adapted for driving the fluid hydraulics to a hydraulic motor that is connected to said drive shaft for providing power to said vehicle wired to a master relay having a plurality of switching contacts for connection to a plurality of sensors, relays and switches that energize operating components to the monitoring system including;

a series of relays and switches operatively connected to a series of electric solenoid valves in said closed circuit circulating system for automatically regulating and controlling the flow of air in said system, an AC-DC converter for providing switching and electricity to resistive electrodes located inside said compression and expansion space of said cylinder and to the face of each said piston for heating of compressed air therein during its expansion, said master relay wired to a DC oscillator for the automatic switching of electric relays for the intermittent energizing of electric solenoids operatively connected to a retractable gear at said tire and that is operatively connected to at least one said alternator, to at least one said hydraulic pump and to at least one said compressor for the recovery of kinetic energy, said master relay wired to at least one electric solenoid operatively connected to at least one clutch mechanism that is operatively connected to at least one alternator, to at least one hydraulic pump, to at least one compressor and to said output shaft, a sensor switch that is preset and adjustable to a predetermined pressure that is adapted to a storage container in said closed circuit circulating system and wired to said master relay providing for switching to said DC oscillator, at least one adjustable mercury switch fixed to said vehicle according to a preset and predetermined gradient position and wired for energizing said master relay and said monitoring system, a pressure sensitive switch wired to said master relay and adapted to brake pedal of said vehicle for energizing the monitoring system in the reovery of kinetic energy, at least one DC generator operatively connected to said drive shaft for generating variable voltage fed to a potentiometer having a preset and prearranged adjustment for feeding said generator voltage to said DC oscillator in proportion to its resistance and according to the speed of rotation of said output shaft.

* * * * *